United States Patent [19]

Baiera

[11] 4,304,065

[45] Dec. 8, 1981

[54] WALKING HAND PUPPET

[75] Inventor: Vincent A. Baiera, Brooklyn, N.Y.

[73] Assignee: Knickerbocker Toy Co., Inc., Middlesex, N.J.

[21] Appl. No.: 179,544

[22] Filed: Aug. 19, 1980

[51] Int. Cl.[3] ..... A63H 3/14

[52] U.S. Cl. ..... 46/154; 272/8 R

[58] Field of Search ..... 46/154, 116, 151, 126; 272/8 N, 8 R; 46/157, 158, 1 R

[56] References Cited

U.S. PATENT DOCUMENTS

| | | | |
|---|---|---|---|
| 2,655,762 | 10/1953 | Burke | 46/154 X |
| 2,681,449 | 6/1954 | Montez | 272/8 R X |
| 2,725,670 | 12/1955 | Hodes | 46/154 X |
| 3,526,990 | 9/1970 | Edmonds | 46/116 |
| 3,942,283 | 3/1976 | Rushton | 46/154 |

*Primary Examiner*—G. E. NcNeill
*Assistant Examiner*—Mickey Yu
*Attorney, Agent, or Firm*—Stoll and Stoll

[57] ABSTRACT

A walking hand puppet in the figure of a walking or crawling land or sea animal, bird, insect or the like, comprising a body with finger-insertable appendages, and a non-functional glove on the body, said glove having a passage formed therein through which a hand is insertable to insert the fingers into the appendages and to manipulate them in simulation of walking or crawling. The presence of the glove creates the optical illusion that the hand is received and held therein, which raises the question of how the appendages are manipulated.

3 Claims, 4 Drawing Figures

WALKING HAND PUPPET

BACKGROUND OF THE INVENTION

1. Field of the Invention

This invention relates to the general classification of hand puppets but, more particularly, to hand puppets in the figure of a walking or crawling land or sea animal, bird, insect or the like, having a body, including a head, with finger-insertable appendages, for example, arms in the case of an octopus and legs in the case of an insect, and both arms and legs in the case of a crustacean.

2. Prior Art

The closest prior art known to applicant consists of the following U.S. patents:

| U.S. Pat. No. | Inventor |
|---|---|
| 1,417,860 | Reich |
| 2,655,762 | Burke |
| 2,756,448 | Werbe |
| 3,032,922 | Mitchell |
| 3,942,283 | Rushton |

The closest of these prior art patents in Rushton U.S. Pat. No. 3,942,283. The patent discloses a hand puppet in the form of a stuffed animal having a head, a body, a pair of forelegs and a pair of hind legs. A pocket is formed in the body to receive a hand. One finger projects into the head, two fingers project into the forelegs and two fingers into the hind legs. The respective fingers manipulate the respective parts into which they are inserted, this being a conventional method of operating a hand puppet, and the effect produced being a conventional effect. The stuffed animal to which the Rushton patent relates has an erect position, whether it be standing or sitting, the animal is essentially erect. The construction therefore is conducive to causing the hand puppet to engage in a walking or crawling movement.

The Rushton hand puppet is conventional in another respect: It makes no pretense of concealing the fact that its movable parts are manipulated by the fingers of the inserted hand.

SUMMARY OF THE INVENTION

A hand puppet suited for the purposes of this invention should have a construction conducive to walking or crawling movement or the like. This means that the appendages, whether arms or legs or both, should be located and oriented in such manner as to enable them to engage a horizontal surface, such as a floor, stage or a horizontal platform. This is not to suggest that the hand puppet herein described and claimed may not be used in another form of movement, e.g., climbing a vertical wall.

It is clearly a purpose of this invention to provide a hand puppet of the character described which may be used to simulate walking or crawling or the like on an appropriate support.

Another important feature of the invention is its use of a glove which is integral with the body (including head) of the figure in which the hand puppet is formed. The glove, however, is non-functional in the sense that its fingers are not used to receive the fingers of the inserted hand. The fingers of the glove are stuffed to simulate a glove with hands and fingers inserted therein in conventional manner. In fact, however, the glove has no utilitarian function except to provide a passage for a hand to provide access for the fingers of the hand into the appendages of the figure in which the hand puppet is formed. What is visible to the observer is a hand puppet in the form of a figure of the character described, having a glove secured thereon, and said glove concealing an inserted hand. The appendages of the figure may be seen to engage in a walking or crawling movement or the like but the cause of such motion is not visible, since, ostensibly, the hand is inserted into the glove. It is accordingly a principal object of this invention to provide a hand puppet of the character described, wherein the appendages are caused to move by the inserted fingers of a hand, while the presence of the glove suggests that it is in the glove that the hand is lodged.

DETAILED DESCRIPTION OF A PREFERRED EMBODIMENT OF THE INVENTION

Figure 3:
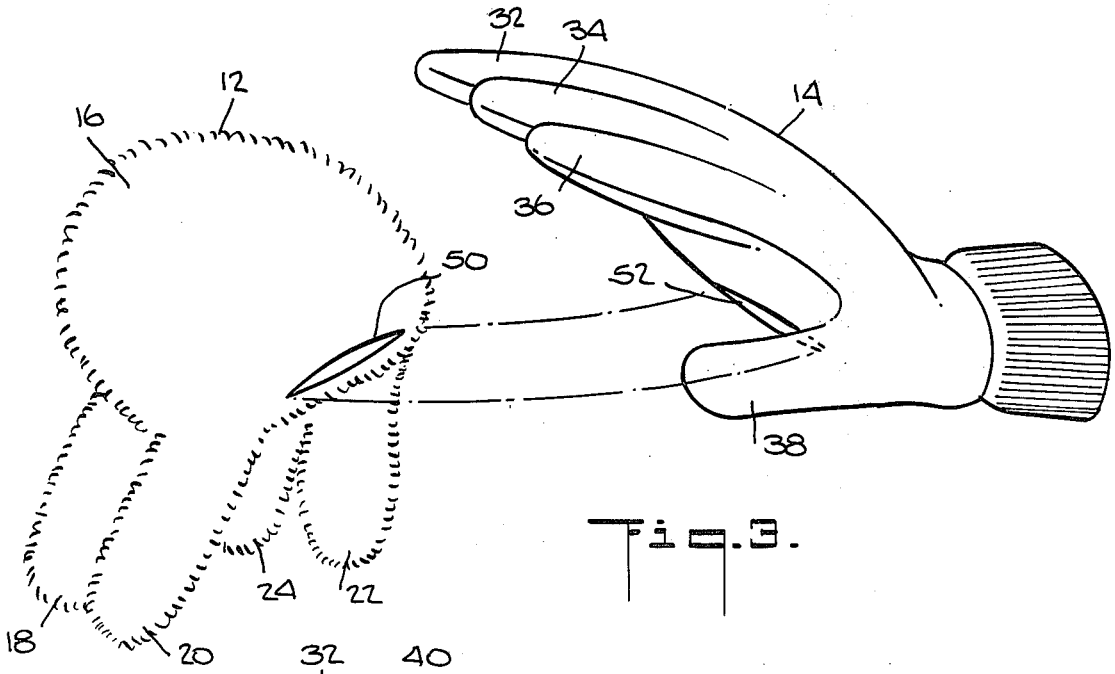
FIG. 3 is an exploded perspective view showing the two major components of the hand puppet herein described and claimed, namely, the hand puppet itself and a glove adapted to be mounted on the hand puppet, connected openings being shown as between the hand puppet and the glove.

Referring now to the details of the invention as illustrated in the drawing it will be observed that a hand puppet 10 made in accordance with the principles of this invention comprises two major components: a hand puppet proper 12 and a glove 14. This is seen in the exploded view of FIG. 3. When the two components are secured together they assume the construction shown in FIGS. 2 and 4.

Figure 4:
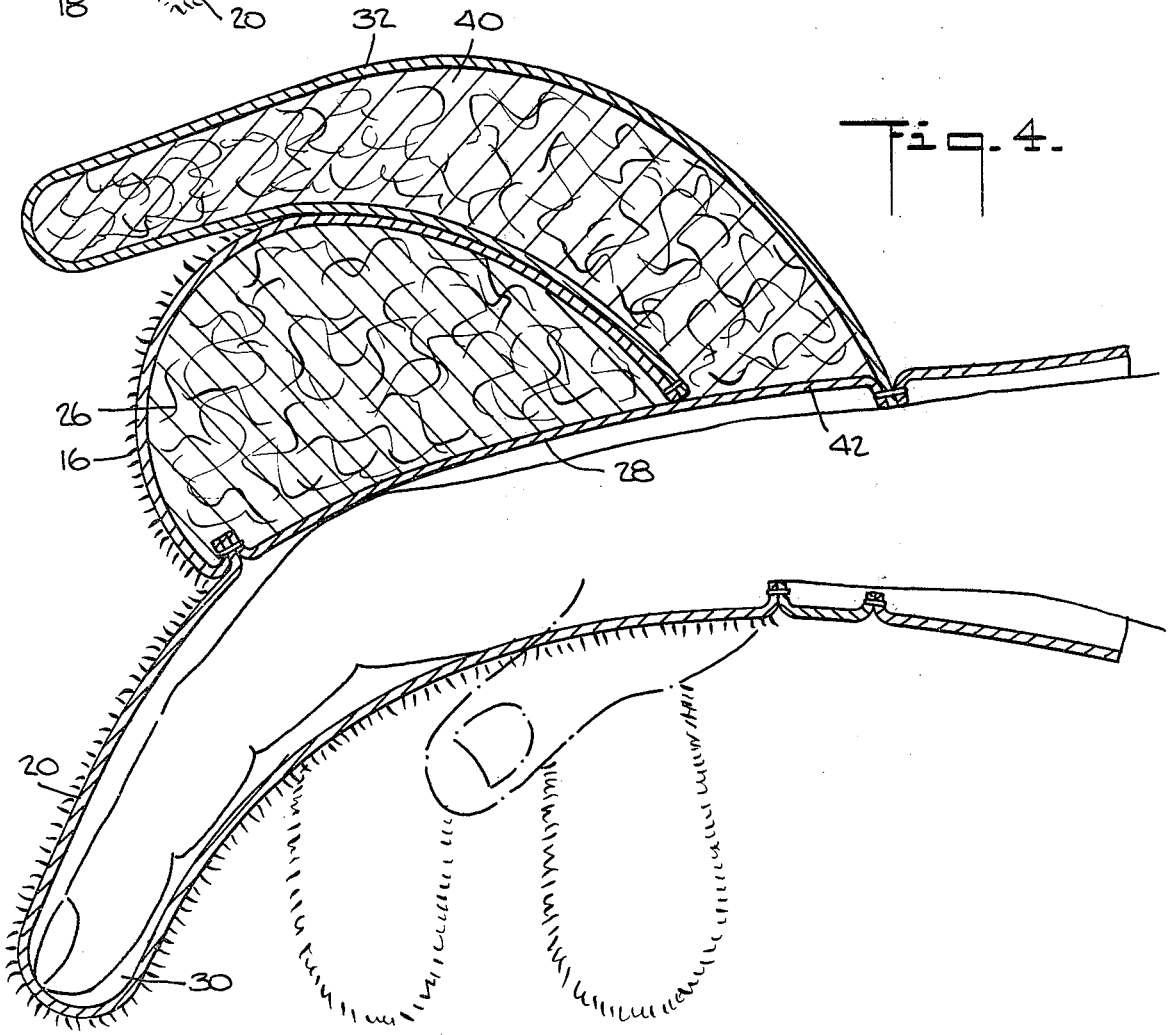
FIG. 4 is an enlarged sectional view showing the construction of a hand puppet, including glove, made in accordance with the present invention, a hand being shown inserted therein.

More specifically, hand puppet 12 is made in the figure or configuration of a spider, this being representative of the various walking or crawling figures or the like to which the present invention applies. Hand puppet 12 made in the form of a spider comprises a body 16, including the head, and a plurality of appendages connected with the body, namely, arms 18, 20, 22 and 24. The body is stuffed with stuffing material 26, as shown in FIG. 4, but the body also is formed with an internal cavity 28 which extends therethrough and communicates with the arms. Also as shown in FIG. 4, the several arms are provided with their own internal cavities 30 and these cavities are continuous or communicate with cavity 28 in the body of the figure. This is clearly shown in FIG. 4.

The glove 14 is non-functional in the sense that its several fingers 32, 34, 36 and 38 are stuffed with stuffing material 40 and closed off by means of a wall 42 to prevent ingress into said fingers. The same wall may also close off the stuffed body portion of the figure to prevent ingress therein.

The glove may be secured to the body of the hand puppet by any conventional means, e.g., sewing or a suitable adhesive. It will be noted that an opening 50 is provided in the skin which forms the envelope for a hand puppet and a corresponding opening 52 is formed in the palm of the glove. These two openings register with each other when the glove is secured to the body of the figure. It is through these registered openings that a hand may be inserted through the glove and into the body of the hand puppet, and the fingers of the hand may be inserted into the cavities of the appendages of the hand puppet. This is clearly shown in FIGS. 3 and 4.

Figures 1, 2:
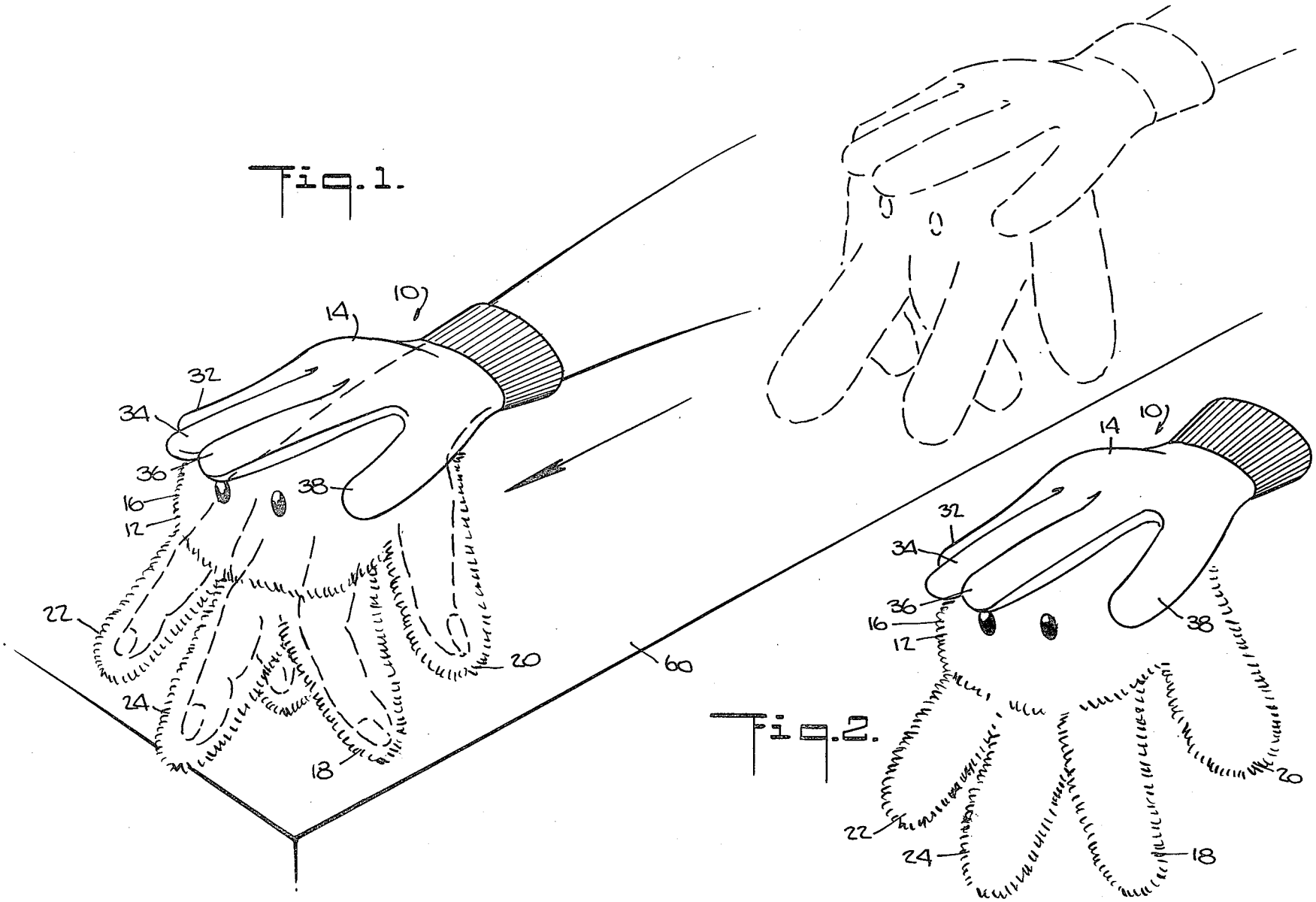
FIG. 1 is an exploded perspective view showing a hand puppet as herein described and claimed and made in the form of a creeping figure such as a spider, also showing the hand puppet engaging in a walking form of locomotion. This figure also shows the hand puppet in phantom or sectional view to disclose the fingers of the inserted hand inserted into the appendages of the figure.
FIG. 2 is another perspective view of a hand puppet made in accordance with the present invention, the glove simulating an inserted hand, but no hand being actually inserted therein.

The operation of a hand puppet made in accordance with the present invention is illustrated in FIG. 1 of the drawing. The hand puppet is shown on a horizontal support surface 60, the several appendages of the hand puppet engaging the horizontal support in walking stance. A hand inserted into and through the glove ostensibly causes the hand puppet to walk on the horizontal surface without manipulating its appendages. What is not seen is the stuffing in the glove which precludes the fingers of the hand from entering the fingers of the glove. And what is also concealed is the presence of the fingers of the hand in the appendages of the hand puppet, these fingers causing the appendages to move as through walking or crawling on the horizontal surface.

Although the present invention is described in terms of walking or crawling or like motion it should be understood that this is not intended by way of limitation. The hand puppet herein described and claimed may perform all of the functions of a conventional hand puppet as, for example, the hand puppet shown in Rushton, U.S. Pat. No. 3,942,238. But the present invention enables the hand puppet herein described and claimed to simulate walking and crawling and like movement, functions not feasible with the hand puppet of Rushton. Regardless of the nature of the movement or motion of the hand puppet herein described and claimed, the use of the non-functional glove precludes the observer from understanding that the fingers of the hand are inserted not in the fingers of the glove but in the appendages of the hand puppet.

The spider figure shown in the drawing is of course only illustrative of the many figures to which the present invention is applicable.

As above indicated, the invention is intended primarily for animals and other life forms which, in nature, walk or crawl or engage in similar motion. Nevertheless the invention is equally applicable to other figures which, in nature, do not walk or crawl.

I claim:

1. A hand puppet in the figure of a land or sea animal, bird, insect or the like with body carrying appendages comprising:

a. a body having a cavity formed therein, b. manually movable appendages connected with the body, said appendages having finger-receiving cavities formed therein in communication with the body cavity, c. means defining a hand receiving opening in said body in communication with said body cavity, d. an open-ended hand-receiving glove having a finger portion an a palm portion, said glove finger portion being formed to provide the appearance of hand fingers therein, said glove being attached to said body with said palm portion covering the opening defined in said body and said finger portion being remote from said appendages, and e. means defining an opening through said palm portion from the interior of said glove and in register with the opening defined in said body for forming an open-ended passage into and through said glove and into concealed communication with the body cavity, f. whereby a hand may be inserted into the glove and through the glove passage into the body cavity and the fingers may be inserted into the appendages to manipulate the appendages in simulation of body carrying movement.

2. A hand puppet in accordance with claim 1, wherein:

the figure is constructed in the form of a stuffed toy.

3. A hand puppet in accordance with claim 2, wherein:

a. the figure is constructed in the form of a stuffed toy spider, b. the body of the figure being the body of the spider including its head, c. the appendages of the figure being the arms of the spider.

* * * * *